United States Patent [19]

Takao

[11] 3,984,897

[45] Oct. 12, 1976

[54] GILLING MACHINE

[76] Inventor: Haruo Takao, 3-5, Higashi 1-chome, Sakurano-cho, Sakai, Osaka, Japan

[22] Filed: Jan. 8, 1975

[21] Appl. No.: 539,598

[52] U.S. Cl. ..... 19/129 R
[51] Int. Cl.[2] ..... D01G 19/10
[58] Field of Search ..... 19/129 R, 127

[56] References Cited

UNITED STATES PATENTS

| | | | |
|---|---|---|---|
| 2,116,201 | 5/1938 | Holdsworth | 19/129 R |

FOREIGN PATENTS OR APPLICATIONS

| | | | |
|---|---|---|---|
| 1,137,942 | 1/1957 | France | 19/129 R |
| 894,820 | 10/1953 | Germany | 19/129 R |
| 895,870 | 11/1953 | Germany | 19/129 R |

*Primary Examiner*—Dorsey Newton
*Attorney, Agent, or Firm*—Robert E. Burns; Emmanuel J. Lobato; Bruce L. Adams

[57] ABSTRACT

A gilling machine having a pair or set of spirally threaded faller screws for advancing gill bars spanning the space between the screws and advancing them in a forward direction with portions of the screws held or engaged by the spiral threads of the faller screws. A first pair of axially spaced wheels which have peripheral notches thereon corresponding with the pitch of the faller screws receive the gill bars from advance or upper faller screws and transfer them to a pair of parallel spaced backward-movement or lower faller screws that move the gill bars in a direction opposite to the forward movement, namely a backward direction. A second pair of axially spaced wheels receive the gill bars from the backward-movement faller screws and transfer them to the forward or advance faller screws. Adjacent the two pairs of wheels are disposed members which define arcuate guide paths or passages through which the gill bars extend transversely and are guided during arcuate movement while held on the periphery of the peripherally notched wheels. Springs disposed adjacent the wheels bear on the gill bars so that they are transferred from the faller screws under the resilient pressure of a plurality of arcuate portions of the springs which are curved to resiliently apply the gill bars against the inner surfaces of the corresponding notches within which they are held in the transfer wheels.

3 Claims, 16 Drawing Figures

GILLING MACHINE

BACKGROUND OF THE INVENTION

The present invention relates to a gilling machine and more particularly to the improvement in a gilling machine in which the gill bars are driven by a pair of upper faller screws and a pair of lower faller screws and resiliently guided during transfer between the sets of faller screws.

Known gilling machines advance the gill bars thereof by a pair of upper and lower faller screws. In these known gilling machines when the velocity of movement of the gill bars is low the gill bars can move smoothly without difficulty. When the velocity or rate of advancement of moving the gill bars is increased it becomes difficult to transfer the gill bars from the forward movement faller screws to the faller screws for a backward movement thereof and from the backward-movement faller screws to the forward or advance faller screws. Furthermore, in these known gilling machines a relatively high noise level is generated in proportion to the increase of velocity. Thus the high speed operation of gilling machines is impeded and it is not possible to maintain a high speed operation in proportion to the high speed operations of other apparatus of the textile machines.

SUMMARY OF THE INVENTION

An object of the present invention is to provide a gilling machine in which gill bars are smoothly advanced by faller screws for forward movement and a backward movement and the travelling of these gill bars can be accomplished at high speeds.

Another object of the present invention is to provide a gilling machine in which the advancement in a forward and a backward direction of the gill bars is accomplished silently and the transfer of the gill bars from the faller screws for forward movement to the faller screws for a backward movement is accomplished at a very reduced noise level.

The gilling machine according to the invention comprises a first pair of spaced parallel spirally threaded forward faller screws driven for advancing a plurality of gill bars in a forward direction extending therebetween. A second pair of spaced, parallel, spirally threaded backward-movement faller screws are disposed in vertical planes corresponding with corresponding ones of the first pair of advance faller screws and driven for transporting the plurality of gill bars in an opposite or backward direction. Means are provided for transferring the gill bars from the advance screws to the backward-movement faller screws and for transferring the gill bars from the backward-movement faller screws to the advance faller screws. A first pair of conveyor or transfer wheels axially spaced on a common axis and driven rotationally in synchronism with the two sets of faller screws receive the gill bars from the advance faller screws and transfer them to the backward-movement faller screws. A second pair of conveyor or transfer wheels axially spaced on a common axis and driven rotationally in synchronism with the faller screws receive the gill bars from the backward-movement screws and transfer them to the advance faller screws. Each of the wheels have angularly spaced peripheral notches which are in correspondence with the pitch of the faller screws for receiving the gill bars therein.

The gilling machine is provided with an improvement intermediate the first and second pairs of peripherally notched wheels which define arcuate guide passageways through which the gill bars are advanced extending transversely thereof during advancement thereof by the wheels as the gill bars are moved along the arcuate paths while disposed spanning the corresponding sets of transfer wheels. Provision is made for maintaining the gill bars in contact with and well seated in the corresponding notches of the transfer wheels. This is accomplished by four groups or sets of springs which are disposed adjacent the wheels and the guideways and bear on the gill bars as they extend transversely of a corresponding set of wheels and resiliently apply the gill bars against the surfaces defining the guideways and against the notches of the transfer wheels.

BRIEF DESCRIPTION OF THE DRAWINGS

Other features and advantages of the gilling machine in accordance with the invention will appear from the following description of an example of the invention, and the novel features will be particularly pointed out in the appended claims and drawing.

DESCRIPTION OF THE PREFERRED EMBODIMENTS

Figure 1:
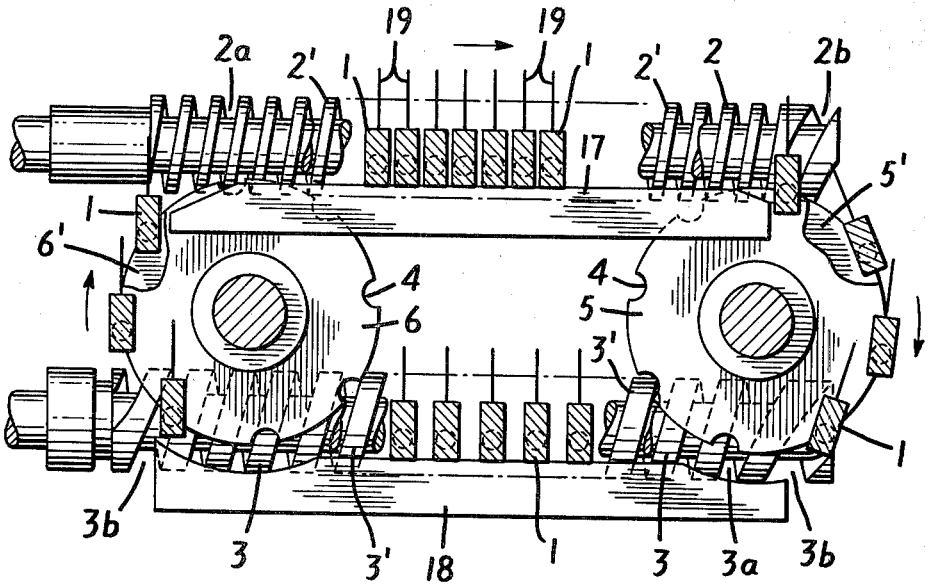
FIG. 1 is a side elevation view of a part of a gilling machine according to the present invention.
Figure 2:
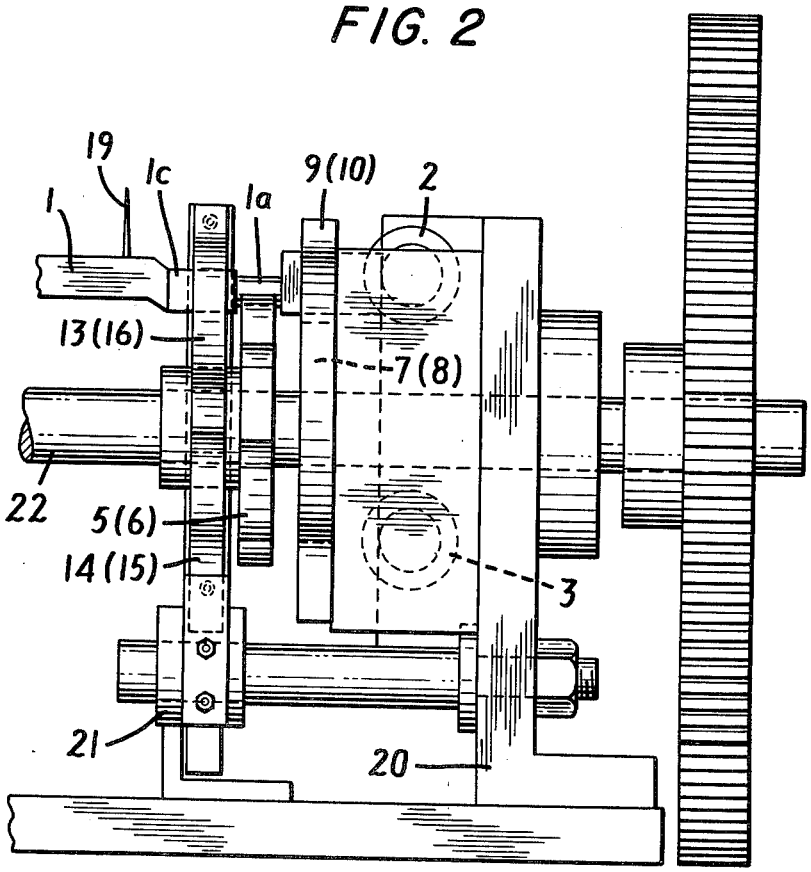
FIG. 2 is a fragmentary front elevation view of the gilling machine illustrated in FIG. 1.
Figure 3:
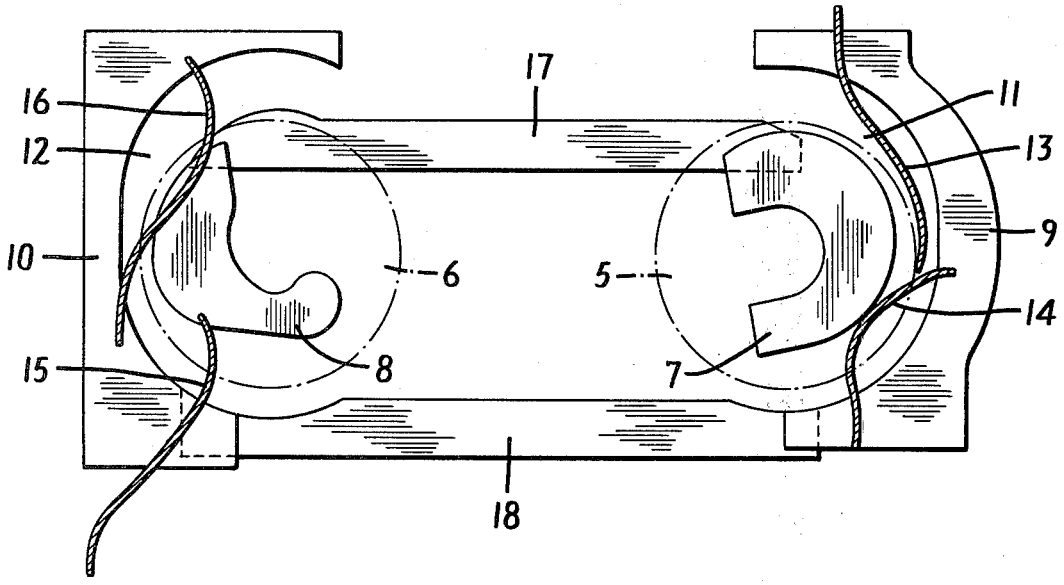
FIG. 3 is a diagrammatic section view, on an enlarged scale, of arcuate passages or guides according to the present invention.
Figure 4:
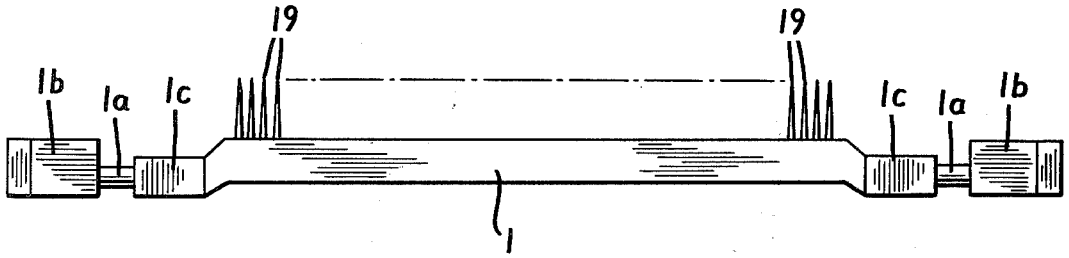
FIG. 4 is a front side elevation view of a gill bar according to the invention.

A gilling machine according to the invention as illustrated in FIGS. 1–3. As shown in the drawing a plurality of gill bars 1 are disposed spanning between a pair of parallel, spaced, upper or advance faller screws 2,2' and are advanced in a forward direction toward the right of the drawing by the spiral threads or grooves **2*a* in which the ends 1*b* of the gill bars 1 are received. The ends 1*b* are configured to engage in the grooves or threads for parallel movement of the gill bars extending generally transversely of the longitudinal axis of the two upper faller screws 2, 2'. These gill bars 1 are to be advanced and eventually moved in an opposite or backward movement direction by a pair of lower faller or backward-movement screws 3,3'**. The lower faller screws are arranged in parallel relationship and each has its longitudinal axis in the same plane as the corresponding upper faller screw.

The gilling machine is provided with means for transferring the gill bars in a generally upright position from the upper faller screws to the lower faller screws and vice versa. This transfer is effected by a pair of conveyor or transfer wheels 5, 5' axially spaced on a common axis. Provision is made for transferring the gill bars from the lower faller screws 3, 3' to the forward movement or upper faller screws 2, 2' by means of a pair of conveyor or transfer wheels 6 axially spaced on a common axis. The transfer wheels are driven synchronously with the two pairs or sets of faller screws and each have peripheral notches 4 provided on the periphery disposed therein in a proper pitch corresponding with the pitch of the helical threads of the faller screws so that the notches are in position to effect the transfer from the screws to the transfer wheels and from the transfer wheels to the screws as described above.

In order to more smoothly switch over or transfer the gill bars 1 from the upper faller screws 2 to the transfer or conveyor wheels 5, 5' the end thread or groove **2*b* at the end of the individual upper faller screws 2, 2' is wider than the thread or grooves 2*a* along the length of the upper faller screws. An end thread or groove 3*b* on each of the lower faller screws 3, 3' is wider than the guide groove or threads 3*a* of the lower faller screws. Thus the wider end thread 3*b* allows a more smooth transfer of the gill bars to the transfer wheels 6, 6'**.

The gilling machine is provided with guide members that define arcuate guide paths within which the guide portion **1*c* of the gill bars are disposed and extend transversely thereof. The guide paths are constructed or defined by inner and outer guide members disposed adjacent the ends of the gill bars and close to the faller screws. While the guide elements for one end of the gill bars will be described and are illustrated in FIGS. 2 and 3 it will be understood that FIG. 2 shows one set of guides while an opposite end guide structure or opposite hand guide structure is omitted in FIG. 2.** It being understood that the faller bars are guided at opposite end portions thereof as described with respect to the guides to be described.

The guides are constructed by inner circumferential guide members 7, 8 and outer circumferential guide members 9, 10. The inner guide members are spaced from the outer guide members and define arcuate guide passages 11, 12 within which are guided the guide portions **1*b* of the gill bars. The gill bars are moved along arcuate paths within the limits of the arcuate guide passages 11, 12.**

In order that the gill bars are moved smoothly through the arcuate passages a plurality of curved arcuate plate springs 13, 14 and 15, 16 are arranged on spring fitting members 21 fixed on a frame 20. As shown in FIGS. 11A–11F the springs 13, 14 and 15, 16 act on a portion **1*c* of the individual gill bars. So that the shaft portion 1*a* of the gill bars 1 engaged within the guide grooves 4 of the conveyor or transfer wheels 5 are prevented from leaving the guide notches 4 when the gill bars 1 move though the arcuate passages 11, 12. At the same time the attitude of the gill bars is controlled and they are transferred with their needles 19 thereon substantially upright. The springs and guide paths eliminate the generation of vibrations and the gill bar transfer speed can be increased so that the movement of the gill bars is effected smoothly and silently. It will also be remembered that the end grooves 2*b*, 3*b*** of the screws of the faller screws are constructed to assist in the smooth transfer of the gill bars between the faller screws and the conveyor or transfer wheels.

The pitch and speed of rotation of the faller screws and the pitch and peripheral velocity of the guide grooves 4 of the conveyor wheels are previously set and controlled. The faller screws 2, 3 are rotated by suitable driving means, not shown, so that the gill bars 1 are moved in the direction of the arrow to the right as described heretofore and when the gill bars 1 come to the end of the guide grooves **2*a* of the upper faller screws 2, 2' they leave the end groove 2*b* of the end and at the same time the driven shaft part 1*a* of the gill bars are inserted into the guide grooves 4 of the conveyor or transfer wheels 5, 5'. The gill bars are carried by the rotation of the conveyor wheels to the circular passages 11 to be received by the end part thread 3*b* of the lower faller screws 3 for a backward movement thereof. During the passage through the guide passage 11, 12 the plate springs 13, 14, 15, 16 press a part 1*c* of the gill bars 1 softly and resiliently towards the conveyor wheels 5, 5'. The gill bars 1 are prevented from leaving the guide grooves 4 of the conveyor wheels 5, 5' and the generation of vibration noises is reduced. Further it will be noted that the shape of these circular passages 11, 12 made by the inner guide members 7, 8 and outer guide members 9, 10 and the arcuate positions of the plates springs 13, 14 can be disposed for maintaining a desired attitude of the gill bars so that they can 3*a* carried exactly to the groove 3a of the lower faller screws 3** for a backward movement.

A similar movement of the gill bars takes place when they leave the lower faller screws and are transported to the upper faller screws 2, 2'. As they pass through the related passages as guide paths the movement of the gill bars is controlled by springs to maintain the attitude thereof as shown in FIGS. 1 and 11A–11F.

Figure 11A:
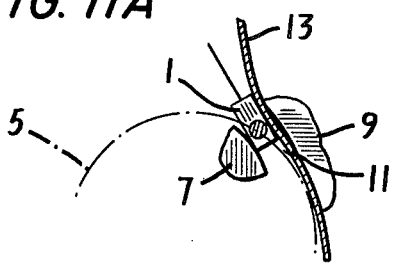
FIGS. 11A–11F are fragmentary diagrams illustrating how the gill bars are switched from the various faller screws and are biased into engagement with the transfer wheels.
Figure 11D:
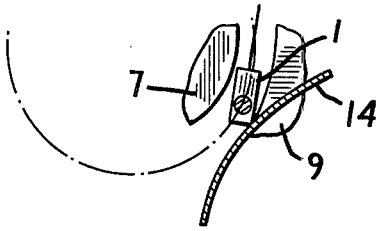
Figure 11B:
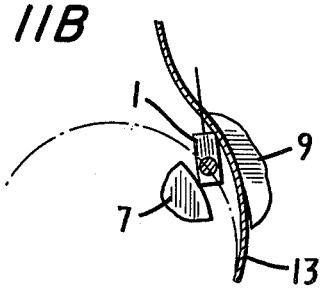
Figure 11E:
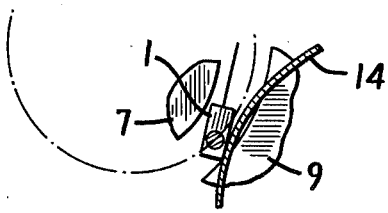
Figure 11C:
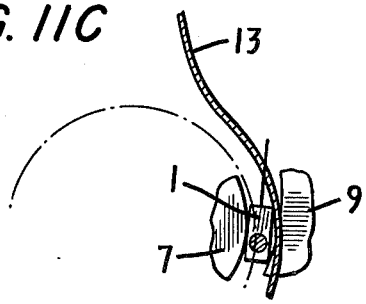
Figure 11F:
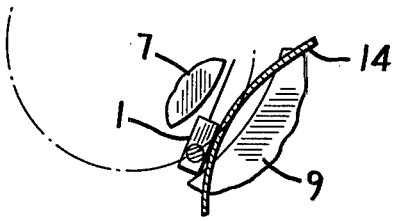

It will be noted that the guide passages are constructed with the spacing between the inner and outer guide members varying along the length of the passage with a narrower passage existing toward the middle of the guide passages. The gill bars are accordingly guided in a substantially upright position and are upright as they pass through the narrower zone. The movement along the guide passages controlled by the springs is illustrated in FIGS. 11A–11C as they are moved along by the transfer wheels from the upper faller screws to the lower faller screws and it can be seen the manner in which the spring 13 deflects and bends to maintain the gill bars housed within the notches and travelling along the guide paths. FIGS. 11D–11F illustrate the cooperation of the lower guide spring 14 as the transfer is effected. The configuration of the springs 15, 16 are illustrated in FIG. 3 and the cooperation of these springs and the gill bars is such as to maintain a smooth transfer from the lower gill faller bars to the upper faller bars with the gill bars retained in a substantially upright position.

Thus it can be seen that the gill bars are circulated with the needles 19 always held substantially in a vertical position so that the starting action on the fibrous layers of the material to be acted on can be smoothly performed and also the leaving of the needles of the fibrous layer can be smoothly effected. In other words the entry into the fibers to be acted on and the leading of the needles of the fibers is effected more smoothly. An almost noiseless gilling machine can be obtained by the action of the arcuate passages 11, 12 and the plates springs 13, 14 and 15, 16.

Figure 5:
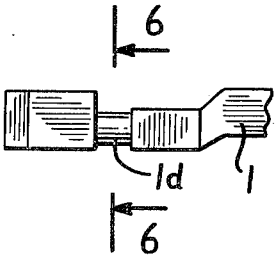
FIG. 5 is a fragmentary end view of the gill bar in FIG. 4.
Figure 6:
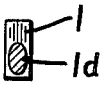
FIG. 6 is a section view taken along Section line 5—5 of FIG. 5.
Figure 7:
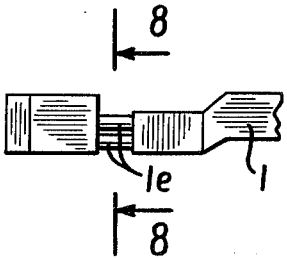
FIG. 7 is a fragmentary end view of a second embodiment of a gill bar used in the gilling machine of the present invention.
Figure 8:
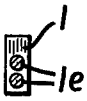
FIG. 8 is a section view taken along Section line 8—8 of FIG. 7.
Figure 9:
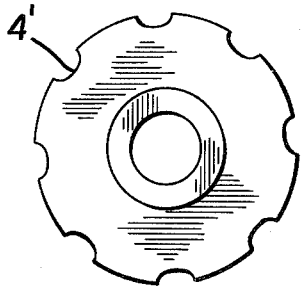
FIG. 9 is a diagrammatic side elevation view of transfer wheels of the gilling machine in FIG. 1.
Figure 10:
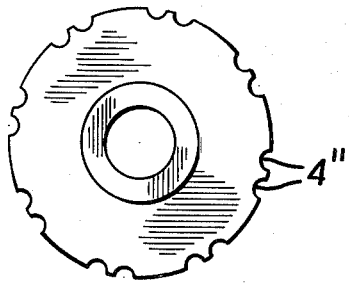
FIG. 10 is a second embodiment of transfer wheels according to the invention.

The driven part 1*a* of the gill bars 1 which are received in the notches 4 of the conveyor wheels are constructed circular in cross section. The notches 4 are semicircular to receive the driven part. Other cross sections may be used. This part may be oval as shown at 1*d* in FIGS. 5 and 6. In order to accomodate this gill bar construction notches 4' on the conveyor wheels are made wider. Another construction of the driven part of the gill bars as illustrated in FIGS. 7 and 8 as two parallel pins 1*e*. In this case the conveyor wheels have paired notches 4'' as shown in FIG. 10 for receiving the gill bars. All of the various constructions allow the gill bars 1 to be recirculated at higher speeds than heretofore possible and the transfer thereof may be made more rapidly and silently.

What I claim and desire to secure by Letters Patent is:

1. A gilling machine comprising, a plurality of gill bars, a first pair of spaced, parallel, spirally threaded advance faller screws driven for advancing said plurality of gill bars in a forward direction and extending therebetween, a second pair of spaced parallel, spirally threaded backward-movement faller screws disposed in vertical planes corresponding with corresponding ones of the first pair of advance faller screws and driven for transporting said plurality of gill bars in a backward direction, first transfer means for transferring the gill bars from the advance faller screws to the backward-movement faller screws, second transfer means for transferring the gill bars from the backward-movement faller screws to the first pair of advance faller screws, said first transfer means comprising a first pair of wheels axially spaced on a common axis and driven rotationally in synchronism with said faller screws for receiving the gill bars from the first pair of advance faller screws and transferring them to the backward-movement faller screws, said second transfer means comprising a second pair of wheels axially spaced on a common axis and driven rotationally in synchronism with said faller screws for receiving the gill bars from the backward-movement faller screws and transferring them to the first pair of advance faller screws, each of said wheels having angularly spaced peripheral notches angular spaced on the periphery thereof corresponding to the patch of the threads on said faller screws for receiving the gill bars therein, guide means adjacent said first pair of wheels and guide means adjacent said second pair of wheels defining arcuate guide paths through which said gill bars are moved extending transversely thereof during conveying thereof by said transfer wheels, each of said gill bars having opposite ends received in a thread of a corresponding faller screw with said gill bars extending between a pair of said faller screws, and means resiliently applying said gill bars in said notches toward said wheels.

2. A gilling machine according to claim 1, in which said gill bars have needles axially thereon and including spring means for resiliently holding said gill bars housed in said notches, and said spring means comprising portions resiliently biasing the gill bars to maintain them in optimum position with said needles substantially upright when transferred from said faller screws and from said transfer wheels to said faller screws.

3. A gilling machine comprising, a plurality of gill bars, a first pair of spaced, parallel, spirally threaded advance faller screws driven for advancing said plurality of gill bars in a forward direction and extending therebetween, a second pair of spaced parallel, spirally threaded backward-movement faller screws disposed in vertical planes corresponding with corresponding ones of the first pair of advance faller screws and driven for transporting said plurality of gill bars in a backward direction, first transfer means for transferring the gill bars from the advance faller screws to the backward-movement faller screws, second transfer means for transferring the gill bars from the backward movement faller screws to the first pair of advance faller screws, said first transfer means comprising a first pair of wheels axially spaced on a common axis and driven rotationally in synchronism with said faller screws for receiving the gill bars from the first pair of advance faller screws and transferring them to the backward-movement faller screws, said second transfer means comprising a second pair of wheels axially spaced on a common axis and driven rotationally in synchronism with said faller screws for receiving the gill bars from the backward-movement faller screws and transferring them to the first pair of advance faller screws, each of said wheels having angularly spaced peripheral notches for receiving the gill bars therein, guide means adjacent said first pair of wheels and guide means adjacent said second pair of wheels defining arcuate guide paths through which said gill bars are moved extending transversely thereof during conveying thereof by said transfer wheels, each of said gill bars having opposite ends received in a thread of a corresponding faller screw with said gill bars extending between a pair of said faller screws, and said faller screws each comprise threads having a wider thread in an end zone in which transfer of the gill bars is effected from the first pair of advance faller screws to said first pair of wheels and in an end zone in which transfer of the gill bars is effected from backward-movement faller screws to said second pair of wheels.

* * * * *